United States Patent [19]

Simmons

[11] Patent Number: 4,896,995

[45] Date of Patent: Jan. 30, 1990

[54] GRINDING APPARATUS

[76] Inventor: Joseph R. Simmons, 904 Cherry Hill, No. Little Rock, Ark. 72116

[21] Appl. No.: 357,951

[22] Filed: May 30, 1989

Related U.S. Application Data

[63] Continuation of Ser. No. 172,453, Mar. 24, 1988, abandoned.

[51] Int. Cl.[4] ..... E01C 23/08

[52] U.S. Cl. ..... 404/90; 404/91; 299/39

[58] Field of Search ..... 404/90, 91, 87, 93; 299/30, 36, 39; 51/176, 177, 178, 179

[56] References Cited

U.S. PATENT DOCUMENTS

| | | | |
|---|---|---|---|
| 3,007,687 | 11/1961 | Hatcher | 299/39 |
| 3,037,755 | 6/1962 | Hatcher | 299/39 |
| 3,063,690 | 11/1962 | Cornell | 299/39 |
| 3,087,712 | 4/1963 | Hatcher | 299/39 |
| 3,195,957 | 7/1965 | Hatcher | 299/39 |
| 3,201,173 | 8/1965 | Hatcher | 299/39 |
| 3,208,796 | 9/1965 | Hatcher | 299/39 |
| 3,269,775 | 8/1966 | Hatcher | 299/39 |
| 3,372,560 | 9/1966 | Hatcher | 299/39 |
| 3,407,005 | 10/1968 | Simms et al. | 299/39 |
| 3,409,330 | 11/1968 | Hatcher et al. | 299/39 |
| 3,703,316 | 11/1972 | Hatcher et al. | 299/39 |
| 3,747,981 | 7/1973 | Zuzelo | 299/39 |
| 3,771,831 | 11/1973 | Hatcher et al. | 299/39 |
| 3,868,146 | 2/1975 | Ellis | 299/39 |
| 4,192,551 | 3/1980 | Weimer et al. | 299/30 X |
| 4,333,686 | 6/1982 | Arnswald | 299/39 |

*Primary Examiner*—Bruce M. Kisliuk
*Assistant Examiner*—Gay Spahn
*Attorney, Agent, or Firm*—Richard C. Litman

[57] ABSTRACT

A grinding apparatus for application upon pavement surfaces or the like includes a self-powered, riding machine having one or more grinding heads. The operator is situated immediately above the grinding heads and manipulates the operation of the heads as well as the advancement of the machine, through appropriate controls. The machine includes a bottom frame assembly upon which the majority of the apparatus is mounted. The grinding heads are normally stationary with respect to the bottom frame assembly and are raised and lowered relative the pavement, upon the pivotal displacement of an upper frame assembly which is provided with a forwardmost control arm. This displacement translates as a vertical adjustment of the grinding heads as the bottom frame assembly is raised or lowered. The forward distal portion of the control arm joins with a steerable wheel assembly. Preferably, independent control of the wheel assembly is accomplished by a second, mobile operator. By manipulating the arcuate displacement of the wheel assembly and the vertical displacement between the two frame assemblies, precise directional and griding control are assured.

9 Claims, 3 Drawing Sheets

GRINDING APPARATUS

This is a continuation of co-pending application Ser. No. 07/172,453 filed on Mar. 24, 1988, now abandoned.

FIELD OF THE INVENTION

This invention relates generally, to a powered device for grinding and more particularly, to an improved apparatus especially adapted for cutting or grinding away irregularities in the profile of pavement and bridgedeck surfaces.

BACKGROUND OF THE INVENTION

Attaining the required evenness of pavement surfaces has long involved a tedious and time-consuming process. Standards have been set by Federal and State authorities, prescribing specific requirements as to the surface evenness. A typical standard permits a surface tolerance wherein no high spots of more than ⅛ inch exist beneath a 10 foot straightedge. Any surface exceeding this range must be corrected and the usual procedure is to utilize an apparatus including one or more grinding drums or heads suitable for cutting away the raised spots in the material of the pavement, such as concrete.

Examples of prior apparatus for accomplishing the above operation will be found in U.S. Pat. Nos. 3,703,316 and 3,771,831 issued to Hatcher et al, on Nov. 21, 1972 and Nov. 13, 1973 respectively. These patents show rotary cutter assemblies carried by a frame and which are manipulated by means of fluid cylinders. The frame is adapted to be propelled, as an intermediate component of a tractor-trailer rig.

The need exists for a relatively compact and economical apparatus for the grinding of pavement and which allows precise control of the cutting action so as to properly remove only those raised areas which have been previously marked by the appropriate officials.

SUMMARY OF THE INVENTION

By the present invention, an improved grinding machine is provided and which includes a bottom frame assembly to which is pivotally attached an upper frame assembly. A steerable wheel assembly carried by the forward end of the upper frame assembly constantly engages the ground while control elements connecting the two frame assemblies are manipulated to variably space apart the frames, thereby raising or lowering grinding heads mounted upon the bottom frame assembly.

Accordingly, one of the objects of the present invention is to provide an improved grinding apparatus including a lower frame containing forward grinding heads and rear drive wheels with an upper frame pivoted at its rear to the lower frame and having a steerable wheel assembly at its forward end.

Another object of the present invention is to provide an improved grinding apparatus including grinding heads mounted on a bottom frame and which are vertically positioned through the displacement of the bottom frame relative an upper frame, the latter provided with one end engageable with the ground or pavement.

Still another object of the present invention is to provide an improved grinding apparatus including a self-propelled machine having a bottom frame equipped with motive means and at least one grinding head with the depth of cut and advancement of the machine being controllable from an operator's cab carried by an upper frame pivoted at one end to the lower frame and vertically displaceable relative the lower frame.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
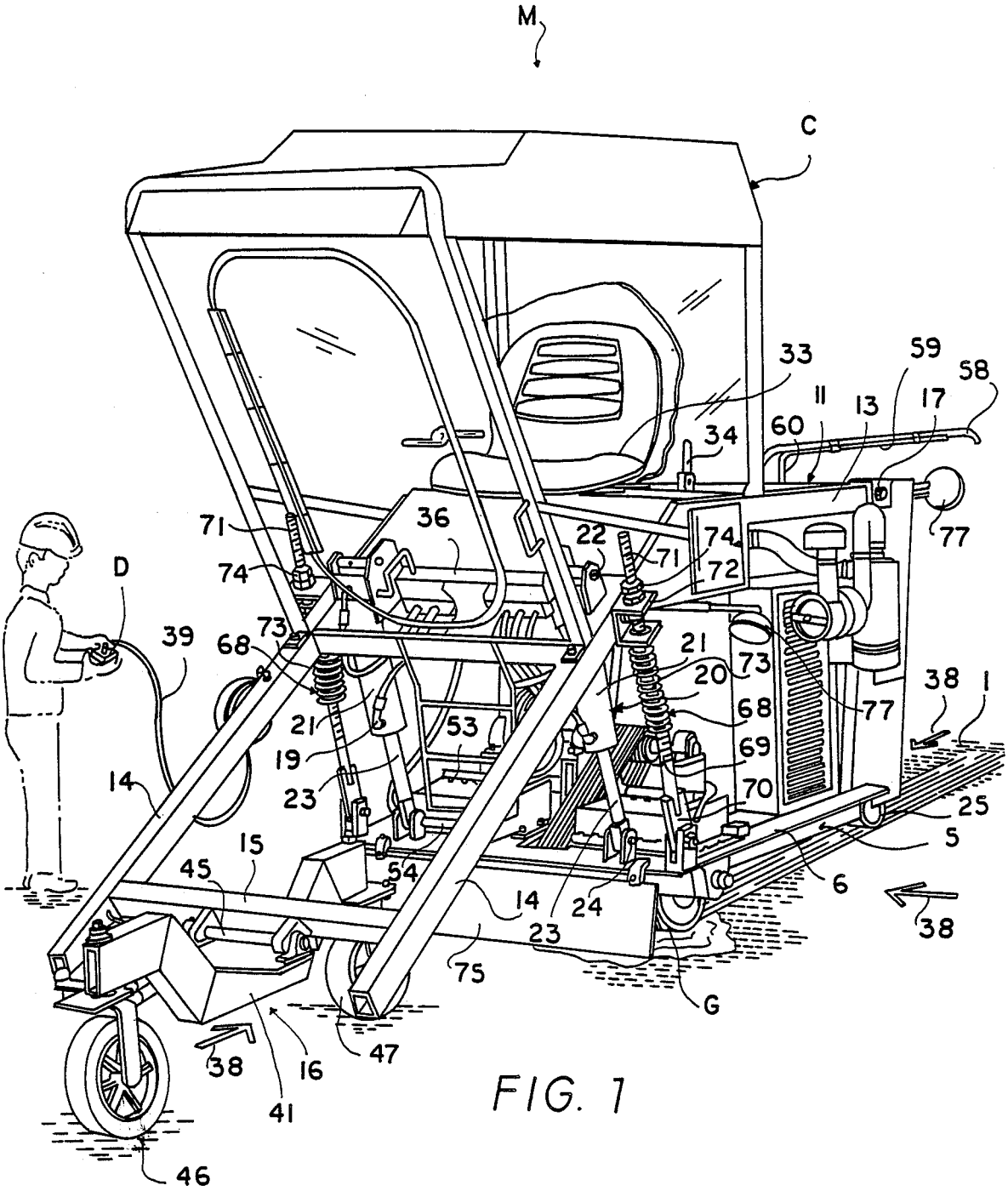
FIG. 1 is a front perspective view of a grinding apparatus according to the present invention.
Figure 2:
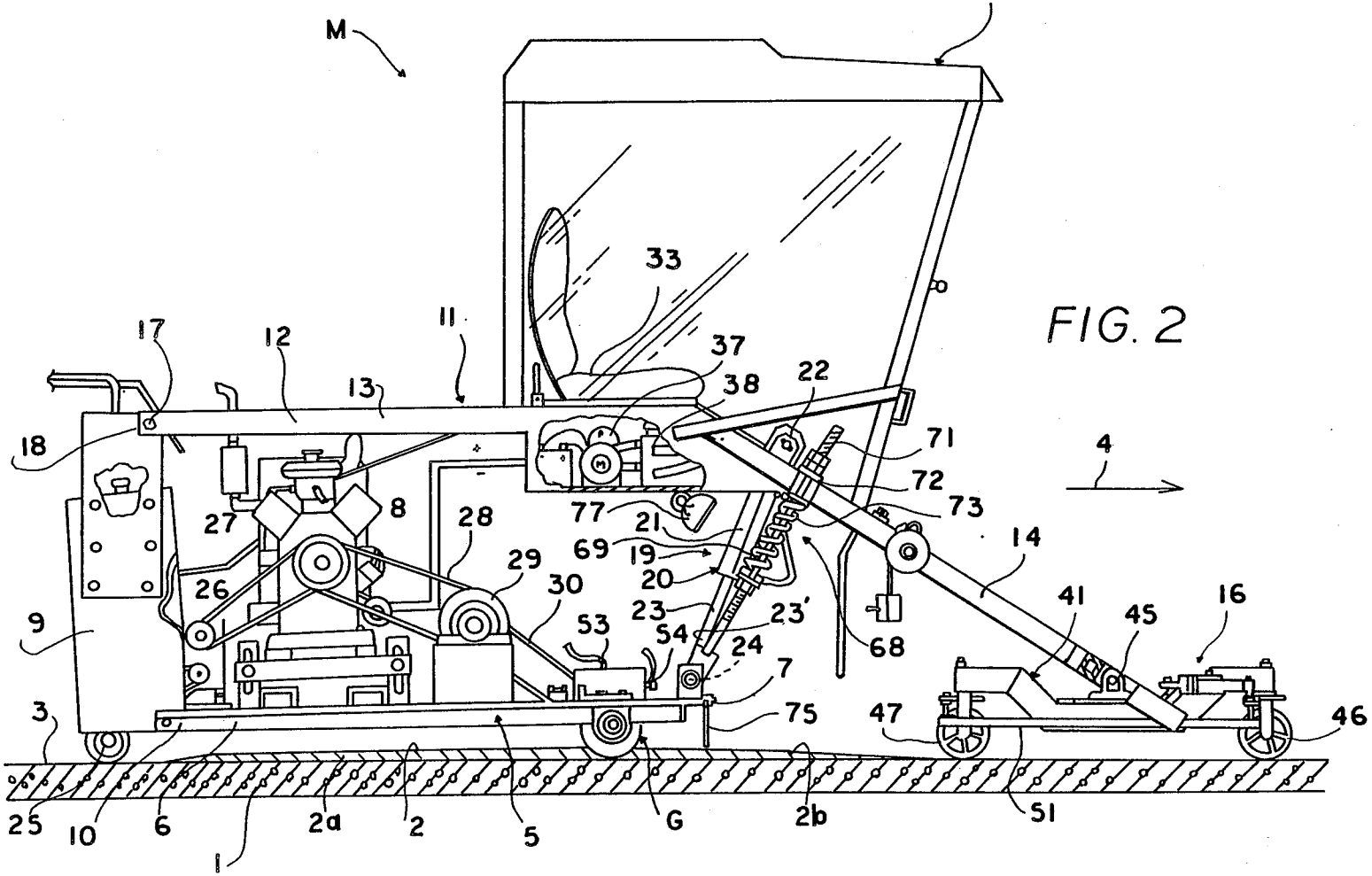
FIG. 2 is a right side elevation of the apparatus shown in FIG. 1.

Referring now to the drawings, particularly FIGS. 1 and 2, the present invention will be seen to comprise a self-propelled machine M containing a pair of adjacent grinding heads G,G, the cutting effect of which is regulated by an operator riding in the cab C directly over the grinding heads. The heads G are manipulated to allow for the precise removal of irregularities as formed in the laying of a roadway, such as the concrete pavement 1. FIG. 2 most clearly illustrates the formation of a bump 2 which is out of range of the profile 3 according to prescribed specifications. Assuming that the bump 2 is wider than the width of the grinding heads G, it will be understood that as viewed in this latter drawing figure, that portion of the bump 2*a* behind the heads has been cut away as the machine advances in the direction of the arrow 4 and the heads continue to cut into the bump portion 2*b*.

The bulk of the machine is situated within a lower frame assembly 5 which includes a lower or bottom frame 6 to which the grinding heads G are attached, adjacent the front 7 thereof. This bottom frame supports suitable motive means such as a diesel or gasoline engine 8, disposed well rearwardly of the heads G and which is supplied with fuel from a tank 9 at the rear 10 of the frame 6.

Cooperating with the lower frame assembly 5 is an upper frame assembly 11 which supports the cab C and includes an upper or top frame 12 comprising rear, horizontal members 13 substantially as long as the bottom frame 6, joined to front, downwardly inclined control arms or members 14. As shown most clearly in FIG. 1 of the drawings, the inclined members 14 are maintained parallel to one another by a transverse cross arm 15, the latter serving to support a steerable wheel assembly, generally designated 16.

The upper frame assembly 11 is joined to the bottom frame assembly 5 by means of pivot elements 17 connecting the rear portions 18 of the members 13 to the elevated portion above the rear of the bottom frame assembly.

With the structure in mind as described to this point, it will be apparent that upon actuation of the grinding heads G, there would be no control over the permissible depth of cut by the heads into the pavement 1, since gravity would allow the heads to continue cutting even until the front 7 of the bottom frame contacted the pavement. Inasmuch as the nature of the desired cutting action usually involves removing no more than a depth of ⅜ inch, it is apparent that a very precise depth control is necessary with such an apparatus.

Such control as referenced above is provided by means of a frame control mechanism 19 spanning the two frame assemblies 5,11 and which comprises a pair of fluid assemblies 20 each including a cylinder 21 pivotally attached at its upper portion to the rear of the front members 14, as at 22 and having a piston shaft 23 with its lower end 23' pivotally attached as at 24, adjacent the front 7 of the bottom frame 6. With this arrangement, it will be seen that the elevation of the grinding heads G relative the pivotally attached top frame assembly 11 is controllable upon the extension or contraction of the two fluid assembly shafts 23.

To provide forward or rearward motion of the machine M, drive wheels 25 are mounted adjacent the rear 10 of the bottom frame 6 and are drive by a hydrostatic gear drive 26, in turn driven by the drive belt 27 from the engine 8. The engine will be seen also to include a drive belt 28 connected to a forward transfer mechanism 29 adapted to drive the grinding heads G. As shown most clearly in FIGS. 2 and 3, a plurality of final drive belts 30 provide a connection between the transfer mechanism 29 and a multi-grooved grinding pulley 31 fixed to shafts 32 supporting the two laterally adjacent grinding heads G,G. In this manner, an operator riding upon the seat 33 within the cab C will be situated directly over the grinding heads and may control the forward or reverse motion of the machine by manipulating a throttle 34 connected to the engine 8. As the throttle is regulated, the rearmost drive wheels 25 and the grinding heads G are rotated. The positioning of the grinding heads contiguous with the side of the side frame elements permits grinding of the pavement as close to the curb as possible.

Each grinding head G will be understood to comprise a plurality of adjacent, segmented diamond toothed circular blades 35 adapted to cut away bumps or elevated portions **2*b*** of pavement in the path of the moving apparatus M. Depending upon the nature or composition of the pavement portion to be removed, the operator regulates the speed of advancement of the machine and thus the grinding action by the heads G.

Perhaps more critical to the operation, is the precise depth of cut being made by the grinding action and this parameter is accurately regulated as the operator controls the elevation of the top frame assembly 11 relative the bottom frame assembly 5. From a control panel 36 intermediate the top pivot mounting points 22 of the two fluid cylinders 21, the operator regulates the admission or exhaust of fluid thereto so as to extend or retract the piston shaft end 23 which is pivotally attached to the bottom frame 6. A suitable fluid pump 37 and reservoir 38 are provided beneath the seat 33 and are likewise supported by the upper frame assembly 11.

In view of the two point support of the upper frame assembly 11, respectively at its rear pivots 17 and the forwardmost steerable wheel assembly 16, it will be seen that as the fluid assemblies 20,20 are extended or retracted, tuhe elevation of the grinding heads G will be altered, with respect to a straight line extending between the rear drive wheels 25 and the steerable wheel assembly 16.

Figure 4:
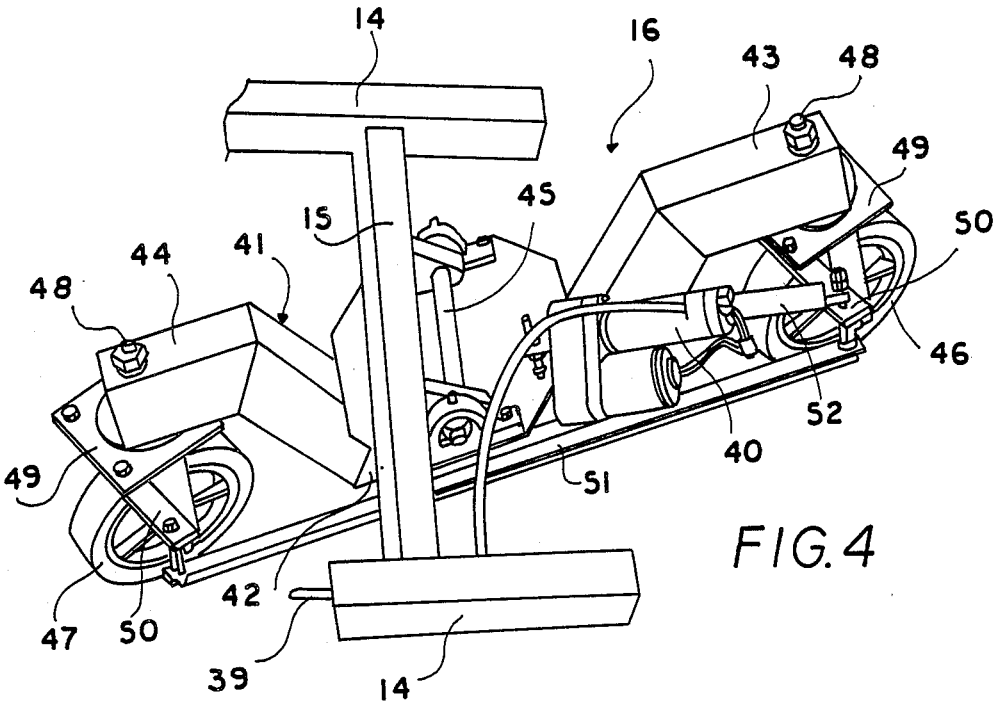
FIG. 4 is an enlarged, fragmentary perspective view of the right side of the forwardmost, steerable wheel assembly.

To facilitate the operator's manipulation of the speed of the apparatus and control of the grinding head depth of cut, highway officials initially mark the pavement 1 with suitable indicia 38, indicating the bounds of the out of specification bump 2 to be removed. The direction or angular advancement of the machine M is best controlled by an additional, remote operator not confined within the cab C and who is free to move independently of the machine. This is accomplished by means of a remote directional control unit D as shown in FIG. 1 and which is connected to the forward wheel assembly 16 through an extendible, flexible control line 39 leading to a power unit 40, illustrated most clearly in FIG. 4 of the drawings.

The steerable wheel assembly 16 will be seen to comprise a longitudinal wheel support channel 41 including a dropped center section 42 joined to front and rear raised wheel mount end portions 43 and 44, respectively. The entire wheel assembly 16 is affixed to the transverse cross arm 15 of the front, control arm members 14 by means of a transverse pivot shaft 45. The upper frame assembly 11 will be understood to be laterally stationary that is, it is displaceable only in a single vertical plane as controlled by the operation of the fluid assemblies 20,20. Thus, the two end portions 43,44 of the steerable wheel assembly 16 likewise will always remain axially aligned with the upper frame assembly 11.

Front and rear steering wheels 46 and 47 are mounted to the end portions 43,44 of the support channel 41, each by means of a vertical pivot shaft 48. To maintain the directional positioning of the wheels 46,47, each is provided with a steering plate 49 from which laterally projects a crank arm 50. A fixed length tie rod 51 has its opposite ends pivotally attached to the two crank arms 50,50 to insure an equal angular disposition of the two wheels 46,47 throughout their pivotal travel. Accordingly, it will be seen that upon manipulation of the remote control unit D by a second operator, the power unit 40 is activated. This latter unit includes a reciprocating shaft 52 having its distal portion pivotally connected to the forwardmost crank arm 50 whereupon displacement thereof is translated to the rearmost crank arm 50 by the tie rod 51 to insure equal and simultaneous angular movement of the two wheels 46,47.

In view of the substantial longitudinal spacing between the two steerable wheels 46,47 and their intermediate pivotal attachment to the front of the upper frame assembly 11, it will be appreciated that an improved, precise control over the cutting effect of the grinding heads G is assured. In other words, any slight surface irregularities in the pavement 1 as engaged by the steerable wheels 46,47 is substantially absorbed by the sequential engagement thereof by the two well spaced apart wheels 46,47, with little or no effect upon the elevation of the upper frame assembly and thus, the grinding heads.

As with most any cutting apparatus, heat is generated by the engagement of the cutting blades 35 with the concrete of the pavement 1. By providing for a constant bathing of the cutting area with a coolant, such as water, not only is the useful service life of the blades 35 prolonged but also, the effectiveness thereof is enhanced by the lubricating effect of the water bath. Additionally, the dust level will obviously be reduced by such action. Accordingly, two transversely disposed water manifolds 53,54 are provided and adapted to be movably positioned adjacent the grinding heads G. As will be seen most clearly in FIGS. 2 and 3 of the drawings, a top manifold 53 and a front manifold 54 are affixed to the outside of an enclosure or hood 55 which is pivotally attached as at 56, to the bottom frame 6 adjacent the grinding heads G. Each manifold includes a plurality of ports 57 projecting within the interior of the hood 55 so that when closed, as shown in FIGS. 1 and 2, water issuing from the ports 57 is directed upon the juxtaposed cutting blades 35.

In view of the large volume of water required to serve the desired effect, as the machine M is utilized say, for an entire day, a supply of water is preferably provided from a separate or remote source such as an adjacent water line or tank. This source (not shown) will be understood to be connected to a flexible hose 58 extending from the rear of the upper frame assembly 11 as shown in FIGS. 1 and 2. To prevent excessive wear of this hose as well as entanglement with the machine, such as during reverse travel thereof, the hose is removably attached to a horizontally disposed support or rod 59 having a vertical section 60 pivotally connected to the upper frame assembly 11.

During operation of the machine M, the rapid rotation of the grinding heads G produces a noticeable splashing of the above described water. In an effort to confine this water and to reduce water flow onto indicia 38 in front of the apparatus, a splash guard 75 extends downwardly from the front 7 of the bottom frame 6.

Figure 3:
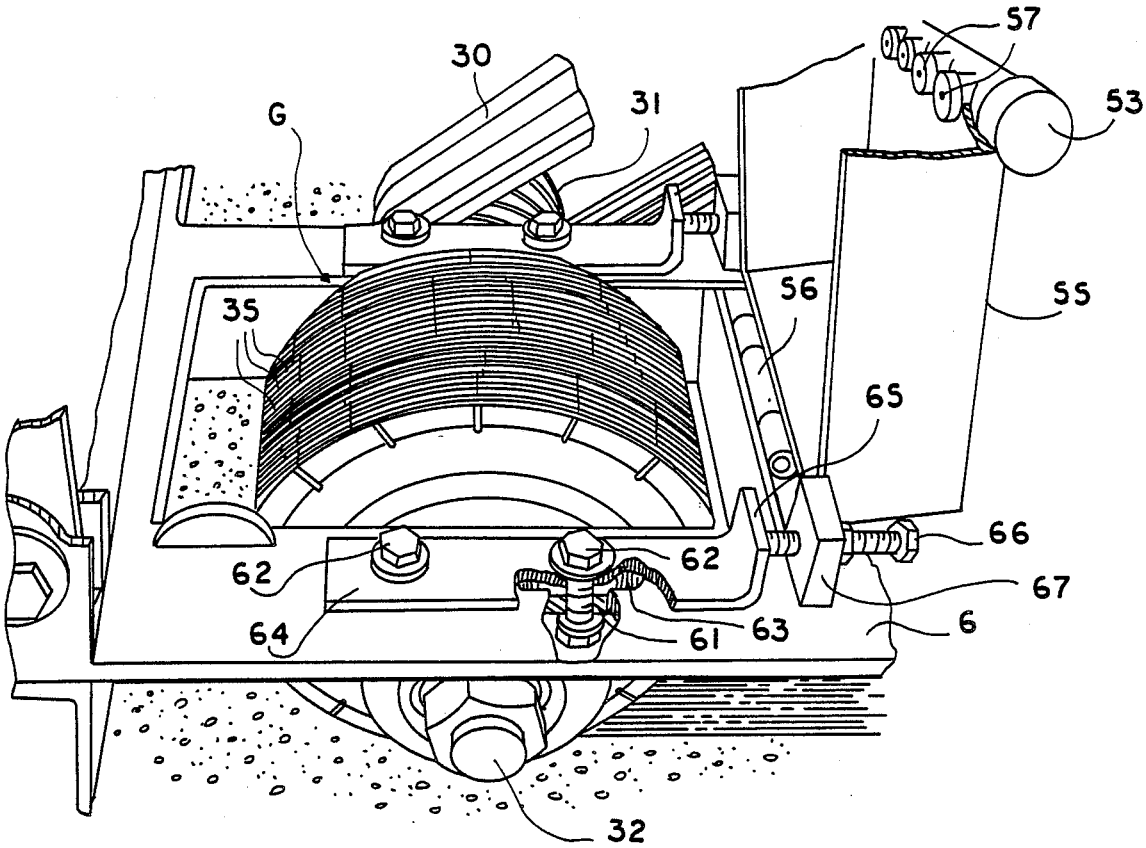
FIG. 3 is an enlarged, fragmentary left side perspective view illustrating one of the grinding heads with the watercooling housing opened.

FIG. 3 most clearly depicts a mounting arrangement for the ends of the shaft 32 of each of the grinding heads G and which permits minute adjustment thereof to assure an exact mounting of the heads normal to the longitudinal axis of the machine M. Each end of each grinding head shaft 32 is supported by a suitable bearing block 61 which is attached to the lower frame 6 by means of a pair of longitudinally spaced fasteners 62,62. These fasteners each pass through a longitudinal slot 63 in the frame as well as through a bore in an adjustment plate 64 atop the frame. Each adjustment plate 64 is provided with an upstanding flange 65 at one end and which is engaged by the free end of a displaceable screw 66 carried by a fixed, threaded block 67. With this construction, it will be seen that manipulation of the screws 66 causes or allows longitudinal shifting of the respective adjustment plates 64 to alter the angular disposition of the grinding heads G, following which the fasteners 62 are tightened.

Structure is also provided to positively limit the relative vertical spacing between the two frame assemblies 5 and 11 to preclude the grinding heads from taking too deep a cut in the pavement. Such structure is necessary since a precise regulation between the two frames is not possible through those controls serving to produce the extension and retraction of the fluid assemblies 20,20. As shown in FIGS. 1 and 2, a pair of frame adjustment mechanisms 68,68 are mounted adjacent the frame control mechanisms 19,19 and each includes a shaft 69 having a lower end 70 pivotally attached to the bottom frame 6 and a threaded upper end 71 slidably disposed through a bracket 72 pivotally connected to one of the upper frame forward control arms 14. A compression spring 73 will be seen to be carried by each shaft 69 beneath the bracket 72 while end nuts 74 atop the brackets permit alteration of the effective length of each shaft 69 and thus the limit of the vertical elevation of each upper frame control arm 14. Accordingly, by manipulation of the end nuts 74, one may define the precise limit of vertical displacement between the two frame assemblies when the fluid cylinders 21,21 are actuated, to thereby establish the degree of cut which will be produced by the grinding heads G.

To provide adequate illumination regardless of the available light, adjustable lights 77 are mounted both at the rear and forward portions of the upper frame assembly as will be seen in FIG. 1.

I claim:

1. A pavement grinding machine for removing high spots comprising:

a lower frame assembly comprising a substantially horizontally disposed frame having opposite front and rear portions joined by side frame elements, drive wheels mounted adjacent said lower frame rear portion, a grinding head assembly mounted adjacent said lower frame front portion between said side frame elements, said grinding head assembly including a pair of laterally spaced apart grinding heads, a main shaft supporting said pair of laterally spaced apart grinding heads, said main shaft having two opposite ends, mounting means on said side frame elements, said main shaft opposite ends being respectively supported by said side frame element mounting means, said grinding heads each respectively having an outer face disposed contiguous with one said side frame element, wherein the juxtaposition of each said grinding head outer face contiguous with one said side frame element permits grinding of the surface of a pavement substantially close to an adjacent curb, motive means mounted upon said lower frame assembly and operable respectively to drive said wheels and grinding head main shaft, a drive pulley on said main shaft intermediate said laterally spaced apart grinding heads, motion transmitting means connecting said motive means and said drive pulley, an upper frame assembly spaced above said lower frame assembly and substantially above said motive means, said upper frame assembly including a pair of laterally spaced apart rearmost substantially horizontal lateral frame members respectively rigidly affixed to a pair of laterally spaced apart co-joined forwardmost and downwardly inclined control arms terminating in forward distal portions, said lateral frame members each having a rearmost portion provided with pivot means attached to a point substantially vertically disposed above and fixed relative said lower frame assembly rear portion, a pavement engaging steerable wheel assembly attached to said control arms adjacent said distal portions substantially forward of said grinding head assembly, a frame control mechanism including a pair of displaceable fluid cylinders each having opposite upper and lower ends, said upper ends respectively attached to said control arms adjacent said horizontal frame members and said lower ends respectively attached adjacent said lower frame assembly front portion, and an operator's cab mounted atop said upper frame assembly and including a seat disposed substantially vertically above said grinding head assembly, whereby actuation of said frame control mechanism pivots said lower frame assembly relative said upper frame assembly about said pivot means to vary the vertical spacing between said upper frame assembly and said lower frame assembly front portion to alter the elevation of said grinding head assembly relative a line extending between said drive wheels and pavement engaging wheel assembly.

2. A pavement grinding machine according to claim 1 wherein, said motive means comprises an internal combustion engine supported upon said lower frame assembly.

3. A pavement grinding machine according to claim 1 wherein, said pavement engagement wheel assembly includes pivotally mounted front and rear wheels, power means operable to steer said front and rear wheels, and means joining said front and rear wheels to maintain equal angular displacement thereof as said front and rear wheels are steered.

4. A pavement grinding machine according to claim 1 including, cooling means comprising a water-discharging manifold disposed adjacent said grinding head.

5. A pavement grinding machine according to claim 1 including, a frame adjusting mechanism having opposite ends engageable with said upper and lower frame assemblies, said adjusting mechanism including a shaft pivotally attached at one said end to one said frame assembly, adjustable limit means carried by the other said end of said shaft and engageable with the other said frame assembly, and spring means urging said frame assemblies apart from one another.

6. A pavement grinding machine according to claim 1 including, a pair of steerable wheels on said wheel assembly, a longitudinally disposed wheel support channel having opposite front and rear end portions, said pair of steerable wheels respectively mounted at said front and rear end portions, and vertically pivoting means attaching said support channel to said forwardmost control arm intermediate said front and rear end portions.

7. A pavement grinding machine according to claim 1 including, control means remote of said machine operable to actuate said power means and, a flexible line joining said remote control means to said power means.

8. A pavement grinding machine according to claim 1 wherein, mounting means for attaching said main shaft to said side frame elements includes releasable adjustable fastener elements shiftable to vary the angular disposition of said main shaft and said grinding heads carried thereon.

9. A pavement grinding machine for removing high spots comprising;

a lower frame assembly comprising a substantially horizontally disposed frame having opposite front and rear portions joined by side frame elements, drive wheels mounted adjacent said lower frame rear portion, a grinding head assembly mounted adjacent said lower frame front portion between said side frame elements, said grinding head assembly including a pair of laterally spaced apart grinding heads, a main shaft supporting said pair of laterally spaced apart grinding heads, said main shaft having two opposite ends, mounting means on said side frame elements, said main shaft opposite ends being respectively supported by said side frame element mounting means, said grinding heads each respectively having an outer face disposed contiguous with one said side frame element, wherein the juxtaposition of each said grinding head outer face contiguous with one said side frame element permits grinding of the surface of a pavement substantially close to an adjacent curb, said mounting means for attaching said main shaft to said side frame elements includes releasable adjustable fastener elements shiftable to vary the angular disposition of said main shaft and said grinding heads carried thereon, motive means mounted upon said lower frame assembly and operable respectively to drive said wheels and grinding head main shaft, said motive means comprises an internal combustion engine supported upon said lower frame assembly, a drive pulley on said main shaft intermediate said laterally spaced apart grinding heads, motion transmitting means connecting said motive means and said drive pulley, an upper frame assembly spaced above said lower frame assembly and substantially above said motive means, said upper frame assembly including a pair of laterally spaced apart rearmost substantially horizontal lateral frame members respectively rigidly affixed to a pair of laterally spaced apart co-joined forwardmost and downwardly inclined control arms terminating in forward distal portions, said lateral frame members each having a rearmost portion provided with pivot means attached to a point substantially vertically disposed above and fixed relative said lower frame assembly rear portion, a pavement engaging steerable wheel assembly attached to said control arms adjacent said distal portions substantially forward of said grinding head assembly, a pair of steerable wheels on said wheel assembly, a longitudinally disposed wheel support channel having opposite front and rear end portions, said pair of steerable wheels respectively mounted at said front and rear end portions, vertically pivoting means attaching said support channel to said forwardmost control arm intermediate said front and rear end portions, power means operable to steer said front and rear wheels, means joining said front and rear wheels to maintain equal angular displacement thereof as said front and rear wheels are steered, a frame control mechanism including a pair of displaceable fluid cylinders each having opposite upper and lower ends, said upper ends respectively attached to said control arms adjacent said horizontal frame members and said lower ends respectively attached adjacent said lower frame assembly front portion, and an operator's cab mounted atop said upper frame assembly and including a seat disposed substantially vertically above said grinding head assembly, whereby actuation of said frame control mechanism pivots said lower frame assembly relative said upper frame assembly about said pivot means to vary the vertical spacing between said upper frame assembly and said lower frame assembly front portion to alter the elevation of said grinding head assembly relative a line extending between said drive wheels and pavement engaging wheel assembly, spring means urging said frame assemblies apart from one another, cooling means comprising a water-discharging manifold disposed adjacent said grinding heads, control means remote of said machine operable to actuate said power means, and a flexible line joining said remote control means to said power means.

* * * * *